US005873264A

United States Patent [19]

Bonaquist et al.

[11] Patent Number: 5,873,264

[45] Date of Patent: Feb. 23, 1999

[54] CRYOGENIC RECTIFICATION SYSTEM WITH INTERMEDIATE THIRD COLUMN REBOIL

[75] Inventors: Dante Patrick Bonaquist, Grand Island; Susan Marie Sattan, Amherst, both of N.Y.

[73] Assignee: Praxair Technology, Inc., Danbury, Conn.

[21] Appl. No.: 932,965

[22] Filed: Sep. 18, 1997

[51] Int. Cl.[6] ..... F25J 1/00

[52] U.S. Cl. ..... 62/646; 62/654

[58] Field of Search ..... 62/646, 654

[56] References Cited

U.S. PATENT DOCUMENTS

| | | | |
|---|---|---|---|
| 5,341,646 | 8/1994 | Agrawal et al. | 62/25 |
| 5,398,514 | 3/1995 | Roberts et al. | 62/646 |
| 5,400,600 | 3/1995 | Grenier | 62/646 |
| 5,402,646 | 4/1995 | Rathbone | 62/24 |
| 5,463,871 | 11/1995 | Cheung | 62/38 |
| 5,485,729 | 1/1996 | Higginbotham | 62/25 |
| 5,546,767 | 8/1996 | Dray et al. | 62/646 |
| 5,551,258 | 9/1996 | Rathbone | 62/646 |
| 5,596,886 | 1/1997 | Howard | 62/646 |
| 5,626,036 | 5/1997 | Koeberle | 62/654 |
| 5,628,207 | 5/1997 | Howard et al. | 62/646 |

*Primary Examiner*—Ronald Capossela
*Attorney, Agent, or Firm*—Stanley Ktorides

[57] ABSTRACT

A cryogenic rectification system for producing lower purity oxygen comprising a double column with a third column reboiled by feed air at an intermediate level and, optionally, in a staged manner at the bottom level.

10 Claims, 2 Drawing Sheets

CRYOGENIC RECTIFICATION SYSTEM WITH INTERMEDIATE THIRD COLUMN REBOIL

TECHNICAL FIELD

This invention relates generally to the cryogenic rectification of air and, more particularly, to the cryogenic rectification of feed air to produce lower purity oxygen.

BACKGROUND ART

Many industries use both lower purity oxygen and high purity nitrogen in their operations. For example, in glass-making the oxygen is used in the glass furnaces as part of an oxy-fuel combustion process and the nitrogen is used as an inerting atmosphere. The power costs to generate these products is high. In an attempt to lower the power cost of generating both lower purity oxygen and high purity nitrogen, the conventional double column system for separating air into high purity oxygen and high purity nitrogen has been modified by the addition of a side column driven by feed air condensing in a bottom reboiler. While this system is very effective, additional power cost reduction is desirable.

Accordingly, it is an object of this invention to provide a cryogenic rectification system for producing lower purity oxygen and, optionally, high purity nitrogen, which operates with reduced power requirements over that of heretofore available systems.

SUMMARY OF THE INVENTION

The above and other objects, which will become apparent to one skilled in the art upon a reading of this disclosure, are attained by the present invention, one aspect of which is:

A method for producing lower purity oxygen comprising:

(A) at least partially condensing feed air, passing the resulting feed air into a higher pressure column, and separating the feed air within the higher pressure column into oxygen-enriched and nitrogen-enriched fluids;

(B) passing oxygen-enriched and nitrogen-enriched fluids from the higher pressure column into a lower pressure column and producing nitrogen-rich fluid and oxygen-rich fluid by cryogenic rectification within the lower pressure column;

(C) passing oxygen-rich fluid from the lower pressure column into a third column and producing lower purity oxygen by cryogenic rectification within the third column;

(D) vaporizing intermediate liquid from the third column by indirect heat exchange with said at least partially condensing feed air; and (E) recovering lower purity oxygen as product from the third column.

Another aspect of the invention is:

Apparatus for producing lower purity oxygen comprising:

(A) a first column, a second column, and a third column having an intermediate reboiler;

(B) means for passing feed air to the intermediate reboiler and from the intermediate reboiler into the first column;

(C) means for passing fluid from the first column into the second column;

(D) means for passing fluid from the lower portion of the second column into the upper portion of the third column; and (E) means for recovering lower purity oxygen from the third column.

As used herein, the term "indirect heat exchange" means the bringing of two fluid streams into heat exchange relation without any physical contact or intermixing of the fluids with each other.

As used herein the term "reboiler" means a heat exchange device that generates column upflow vapor from column liquid.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "bottom" when referring to a column means that section of the column below the column mass transfer internals, i.e. trays or packing.

As used herein, the term "bottom reboiler" means a reboiler that boils liquid from the bottom of a column.

As used herein, the term "intermediate" when referring to a column means that section of the column above the bottom.

As used herein, the term "intermediate reboiler" means a reboiler that boils liquid from above the bottom of a column.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein the term "feed air" means a mixture comprising primarily oxygen and nitrogen, such as ambient air.

As used herein the term "low purity oxygen" means a fluid having an oxygen concentration within the range of from 50 to 98.5 mole percent.

As used herein, the term "high purity nitrogen" means a fluid having a nitrogen concentration greater than 98.5 mole percent.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process*. The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling)

component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

DETAILED DESCRIPTION

The invention will be described in detail with reference to the Drawings.

Figure 1:
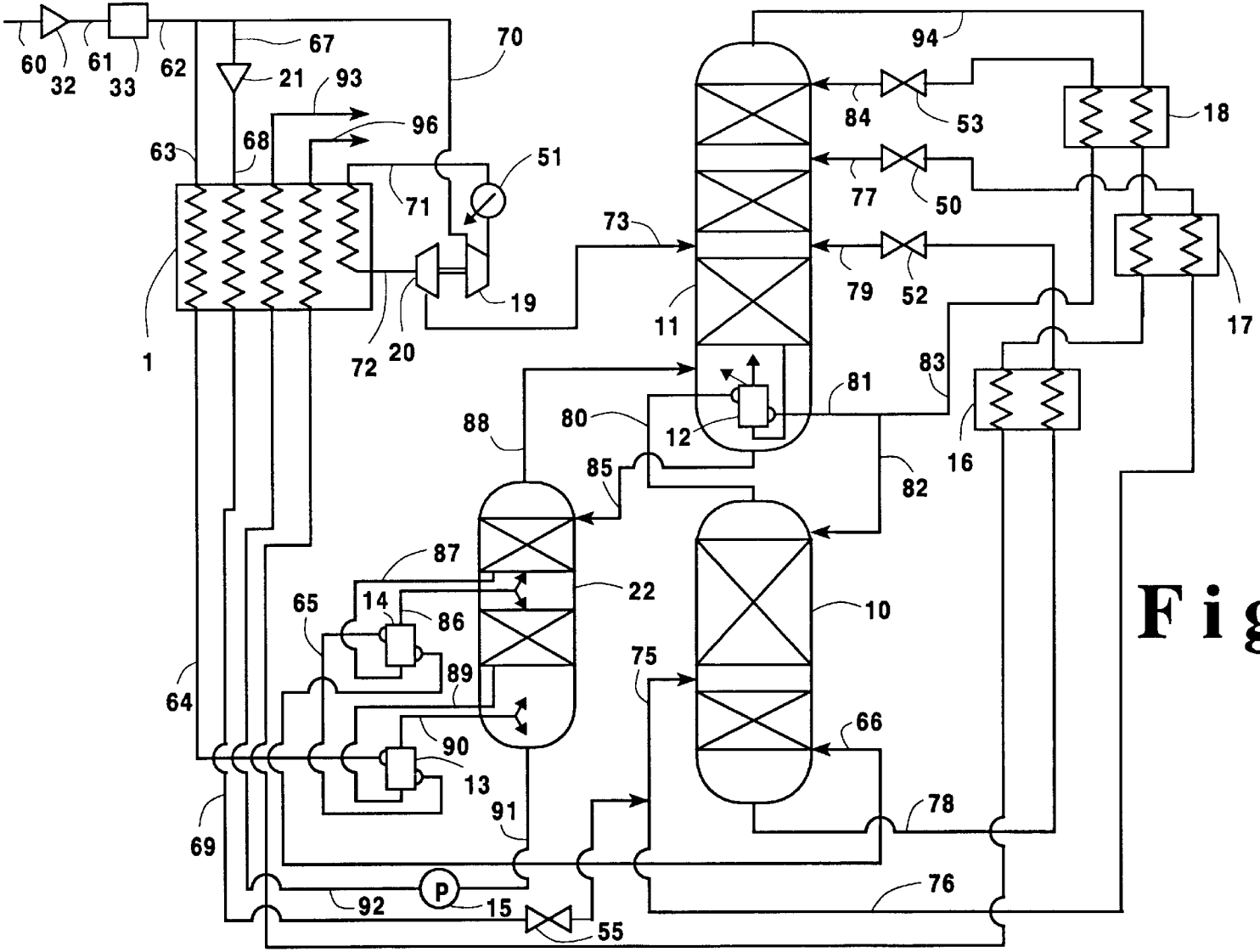
FIG. 1 is a schematic representation of one preferred embodiment of the invention employing staged feed air reboiling wherein feed air undergoes bottom reboiling prior to the intermediate reboiling.

Referring now to FIG. 1, feed air 60 is compressed by passage through compressor 32 to a pressure generally within the range of from 45 to 75 pounds per square inch absolute (psia). Pressurized feed air 61 is cleaned of high boiling impurities such as water vapor, carbon dioxide and hydrocarbons by passage through prepurifier 33. Cleaned, compressed feed air 62 is divided into three portions 63, 67, and 70. Stream 67, which comprises from 20 to 40 percent of feed air 62, is further compressed by passage through compressor 21 to a pressure within the range of from 100 to 600 psia. Resulting further compressed stream 68 is passed through primary heat exchanger 1 wherein it is condensed by indirect heat exchange with return streams. Resulting liquid feed air stream 69 is passed through valve 55 and then divided into stream 75, which is passed into first or higher pressure column 10, and into stream 76, which is subcooled by passage through heat exchanger 17, reduced in pressure by passage through valve 50 and, as stream 77, passed into second or lower pressure column 11. Stream 70, which comprises from 5 to 20 percent of feed air 62, is further compressed to a pressure within the range of from 60 to 90 psia by passage through compressor 19, and cooled of the heat of compression by passage through cooler 51. Resulting stream 71 is cooled by partial traverse of primary heat exchanger 1 and resulting feed air stream 72 is turboexpanded by passage through turboexpander 20 to generate refrigeration. Turboexpander 20 is directly coupled to and drives compressor 19. Turboexpanded feed air stream 73 is then passed from turboexpander 20 into lower pressure column 11.

Feed air stream 63, which comprises from 50 to 70 percent of feed air stream 62, is cooled by passage through primary heat exchanger 1. Resulting feed air stream 64 is passed into bottom reboiler 13 of third column 22 wherein it is partially condensed by indirect heat exchange with bottom liquid 89 of third column 22. Generally from about 8 to 12 percent of feed air stream 64 condenses in the heat exchange with bottom liquid 89 in bottom reboiler 13. Resulting vaporized and unvaporized bottom liquid 90 is passed into the bottom of third column 22.

Feed air from bottom reboiler 13 is passed in stream 65 into intermediate reboiler 14 wherein it is at least partially condensed by indirect heat exchange with intermediate liquid 87 of third column 22. Intermediate liquid 87 is taken from a level at least 2 equilibrium stages above, and generally at a level within the range of from 4 to 8 equilibrium stages above, the bottom of third column 22. Resulting vaporized, as well as unvaporized, intermediate liquid 86 is passed into third column 22 at an intermediate level of the column. The at least partially condensed feed air resulting from the indirect heat exchange with the intermediate liquid in intermediate reboiler 14 is passed in stream 66 into the lower portion of higher pressure column 10.

First or higher pressure column 10 is operating at a pressure generally within the range of from 45 to 75 psia. Within higher pressure column 10 the feed air is separated by cryogenic rectification into nitrogen-enriched vapor and oxygen-enriched liquid. Oxygen-enriched liquid is withdrawn from the lower portion of higher pressure column 10 in stream 78, subcooled by passage through heat exchanger 16, passed through valve 52 and as stream 79, into lower pressure column 11. Nitrogen-enriched vapor is withdrawn from the upper portion of higher pressure column 10 in stream 80 and passed into bottom reboiler 12 of lower pressure column 11 wherein it is condensed by indirect heat exchange with reboiling column 11 bottom liquid. Resulting nitrogen-enriched liquid 81 is divided into stream 82, which is passed back into higher pressure column 10 as reflux, and into stream 83, which is subcooled by passage through heat exchanger 18 and then passed through valve 53 and as stream 84 into lower pressure column 11.

Second or lower pressure column 11 is operating at a pressure less than that of higher pressure column 10 and generally within the range of from 18 to 21 psia. Within lower pressure column 11 the various feeds into the column are separated by cryogenic rectification into nitrogen-rich fluid and oxygen-rich fluid. Nitrogen-rich fluid is withdrawn as vapor from the upper portion of lower pressure column 11 as stream 94, cooled by passage through heat exchangers 18, 17 and 16 and primary heat exchanger 1, and withdrawn from the system as stream 96 which may be recovered, in whole or in part, as product high purity nitrogen. Oxygen-rich fluid, generally having an oxygen concentration within the range of from 75 to 90 mole percent, is passed as liquid from the lower portion of lower pressure column 11 in stream 85 into the upper portion of third column 22.

Third column 22 is operating at a pressure generally within the range of from 18 to 21 psia. Within third column 22 the oxygen-rich fluid is separated by cryogenic rectification into lower purity oxygen and residual top fluid. The residual top fluid is withdrawn from the upper portion of third column 22 and passed into the lower portion of lower pressure column 11. Lower purity oxygen is withdrawn from the lower portion of third column 22 as liquid stream 91. Liquid lower purity oxygen 91 may be increased in pressure by passage through liquid pump 15 and pressurized liquid lower purity oxygen 92 is passed through primary heat exchanger 1 wherein it is vaporized. Resulting gaseous lower purity oxygen is recovered in product stream 93.

Figure 2:
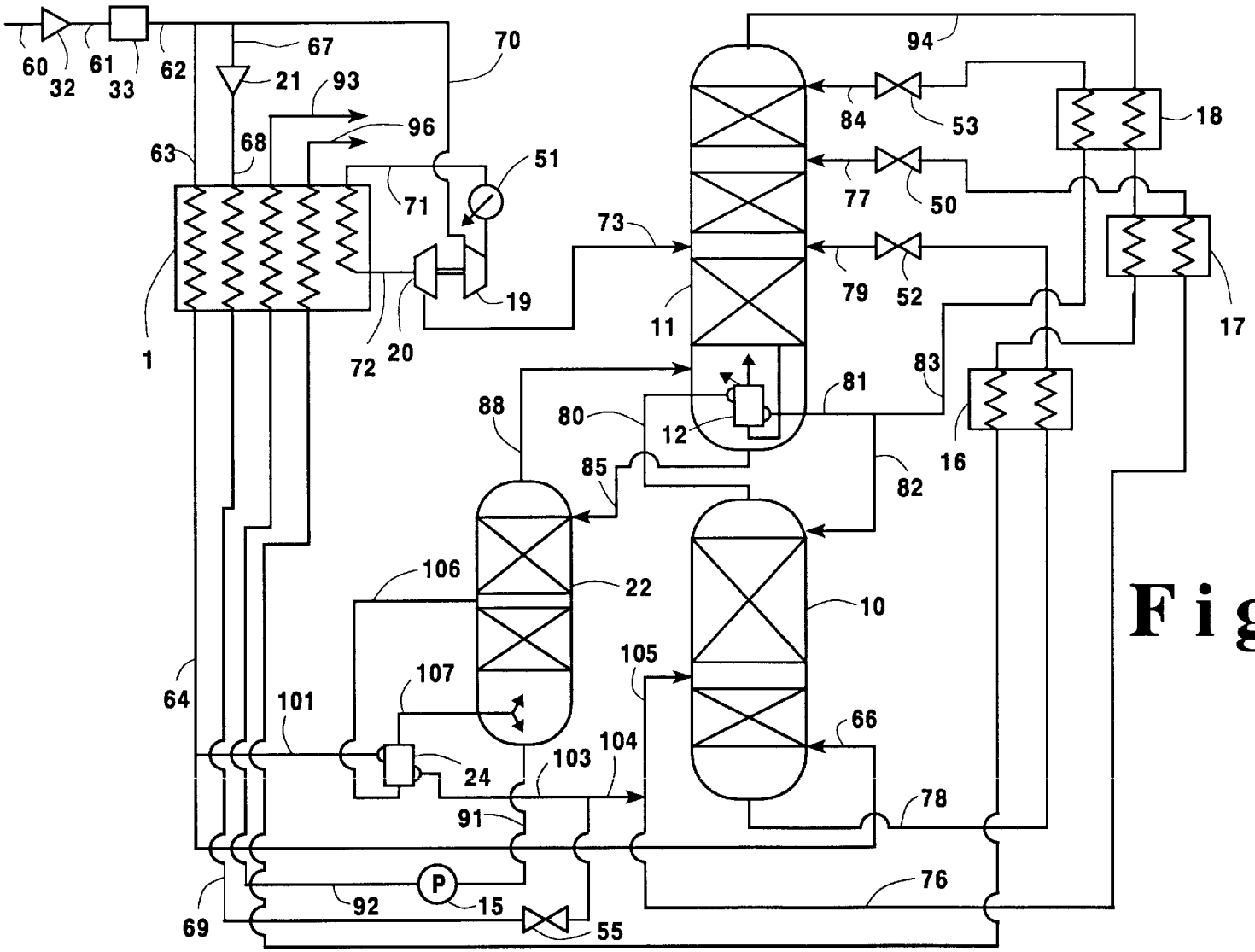
FIG. 2 is a schematic representation of another preferred embodiment of the invention wherein vaporized intermediate liquid is introduced into the bottom of the third column.

FIG. 2 illustrates another preferred embodiment of the invention. The numerals in FIG. 2 correspond to those of FIG. 1 for the common elements, and these common elements will not be discussed again in detail.

Referring now to FIG. 2, cooled feed air stream 64 is divided into first portion 101 and second portion 102. Second portion 102 is passed directly into the lower portion of higher pressure column 10. First portion 101 is passed into intermediate reboiler 24 wherein it is at least partially condensed by indirect heat exchange with intermediate liquid 106 of third column 22. Intermediate liquid 106 is taken from a level at least 2 equilibrium stages above, and generally at a level within the range of from 4 to 8 equilibrium stages above, the bottom of third column 22. Resulting vaporized, as well as unvaporized, intermediate liquid 107 is passed into the bottom of third column 22. The at least partially condensed feed air 103 resulting from the indirect heat exchange with the intermediate liquid in intermediate reboiler 24 is combined with feed air stream 69 to form stream 104. Stream 104 is divided into stream 76, which is processed as previously describe, and into stream 105 which is passed into higher pressure column 10.

With the practice of this invention one can produce lower purity oxygen and, if desired, high purity nitrogen at lower specific power usage than is achievable with conventional side column systems. The intermediate reboiler of the third column allows for a reduction in the requisite purity of the liquid stream from the lower pressure column to the third column. This, in turn, enables a reduction in the operating pressure of the higher pressure column, resulting in the power savings.

Although the invention has been described in detail with reference to certain preferred embodiments, those skilled in the art will recognize that there are other embodiments of the invention within the spirit and the scope of the claims.

We claim:

1. A method for producing lower purity oxygen comprising:

(A) at least partially condensing feed air, passing the resulting feed air into a higher pressure column, and separating the feed air within the higher pressure column into oxygen-enriched and nitrogen-enriched fluids;

(B) passing oxygen-enriched and nitrogen-enriched fluids from the higher pressure column into a lower pressure column and producing nitrogen-rich fluid and oxygen-rich fluid by cryogenic rectification within the lower pressure column;

(C) passing oxygen-rich fluid from the lower pressure column into a third column and producing lower purity oxygen by cryogenic rectification within the third column;

(D) vaporizing intermediate liquid from the third column by indirect heat exchange with said at least partially condensing feed air; and (E) recovering lower purity oxygen as product from the third column.

2. The method of claim 1 wherein feed air is partially condensed by indirect heat exchange with bottom liquid from the third column, and at least a portion of the uncondensed feed air from said partial condensation is used as the said at least partially condensing feed air by indirect heat exchange with the intermediate liquid.

3. The method of claim 1 wherein vaporized intermediate liquid is introduced into the third column at an intermediate level of the third column.

4. The method of claim 1 wherein vaporized intermediate liquid is introduced into the third column at the bottom of the third column.

5. The method of claim 1 further comprising recovering nitrogen-rich fluid as product high purity nitrogen.

6. Apparatus for producing lower purity oxygen comprising:

(A) a first column, a second column, and a third column having an intermediate reboiler;

(B) means for passing feed air to the intermediate reboiler and from the intermediate reboiler into the first column;

(C) means for passing fluid from the first column into the second column;

(D) means for passing fluid from the lower portion of the second column into the upper portion of the third column; and (E) means for recovering lower purity oxygen from the third column.

7. The apparatus of claim 6 wherein the third column additional has a bottom reboiler, further comprising means for passing feed air to the bottom reboiler and means for passing feed air from the bottom reboiler to the intermediate reboiler.

8. The apparatus of claim 6 further comprising means for passing fluid from the intermediate reboiler into the third column at an intermediate level of the third column.

9. The apparatus of claim 6 further comprising means for passing fluid from the intermediate reboiler into the third column at the bottom of the third column.

10. The apparatus of claim 6 further comprising means for recovering fluid from the upper portion of the second column.

* * * * *